US007404470B2

(12) United States Patent
Felder et al.

(10) Patent No.: US 7,404,470 B2
(45) Date of Patent: Jul. 29, 2008

(54) ELEVATOR CAR OPERATING PANEL

(75) Inventors: Hugo Felder, Buchrain (CH); Dennys Taiana, Losone (CH); Marco Aluisetti, Locarno (CH)

(73) Assignee: Inventio AG, Hergiswil NW (CH)

( * ) Notice: Subject to any disclaimer, the term of this patent is extended or adjusted under 35 U.S.C. 154(b) by 525 days.

(21) Appl. No.: 11/101,836

(22) Filed: Apr. 8, 2005

(65) Prior Publication Data

US 2005/0224297 A1 Oct. 13, 2005

(30) Foreign Application Priority Data

Apr. 8, 2004 (EP) ..... 04405215

(51) Int. Cl.
*B66B 1/34* (2006.01)

(52) U.S. Cl. ..... 187/395; 187/391

(58) Field of Classification Search ..... 187/391–396, 187/414

See application file for complete search history.

(56) References Cited

U.S. PATENT DOCUMENTS 5,507,366 A * 4/1996 Huang ..... 187/395
6,029,778 A * 2/2000 Lacarte Estallo ..... 187/414
6,227,335 B1 * 5/2001 Koeppe et al. ..... 187/414

FOREIGN PATENT DOCUMENTS

JP 02225272 A * 9/1990
JP 05178555 A * 7/1993

* cited by examiner

*Primary Examiner*—Jonathan Salata
(74) *Attorney, Agent, or Firm*—Fraser Clemens Martin & Miller LLC; William J. Clemens

(57) ABSTRACT

An elevator car operating panel has push buttons corresponding to floors of a building, wherein the push buttons act on switch contacts registering elevator calls, and wherein the push buttons are mounted on the switch contacts.

14 Claims, 3 Drawing Sheets

Fig. 1
(PRIOR ART)
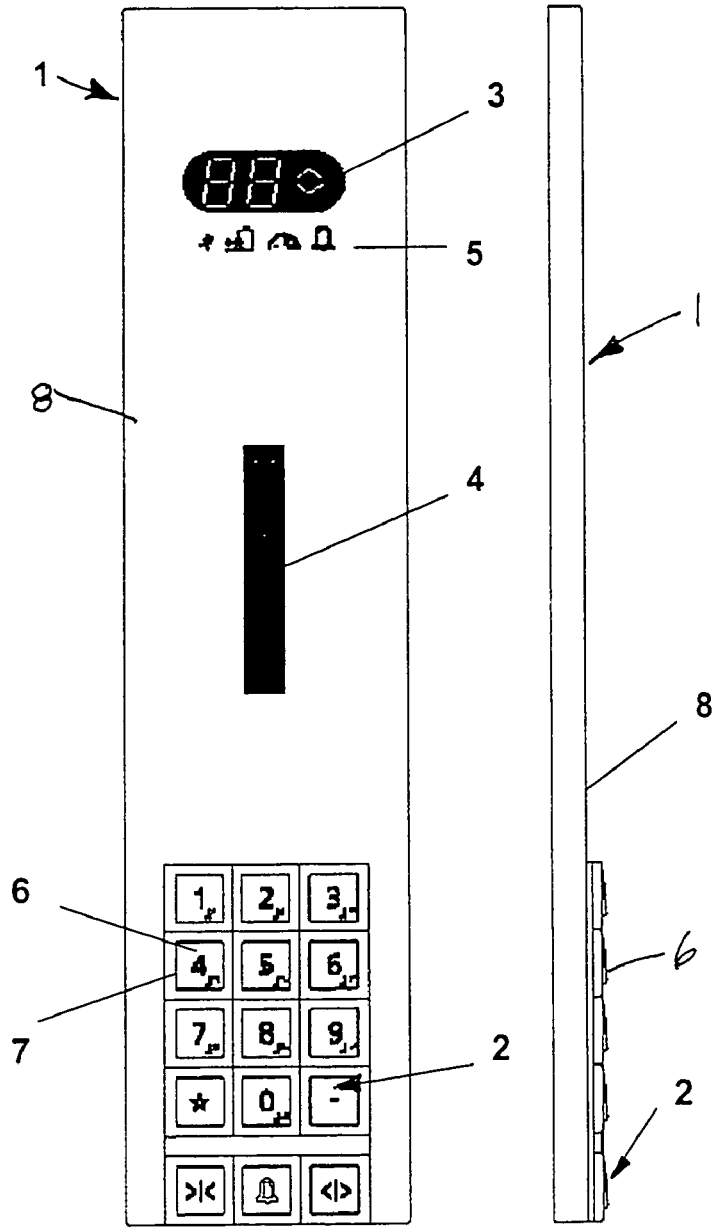
Fig. 1A
(PRIOR ART)
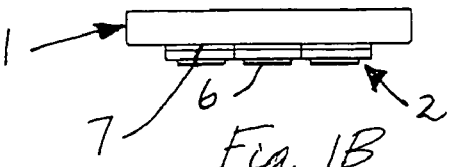
Fig. 1B
(PRIOR ART)

ELEVATOR CAR OPERATING PANEL

BACKGROUND OF THE INVENTION

The present invention concerns an elevator with a car operating panel to register elevator calls In the new generations of inexpensive elevators for small buildings, the concept of a car operating panel with a keypad exhibiting ten digits (0 to 9) was introduced. This 10 digits-keypad system has reached the target of a unique factory produced car operating panel for all elevators, with evident cost and logistic advantages.

As an added feature, due to the presence of a 10 digits-keypad and several displays, the car panel could also be used as a maintenance tool.

Unfortunately, together with the advantages concerning the logistic and maintenance, derived by the fact that always the same car operating panel can be delivered, some important and advantageous features of the old customized car operating panels have been lost.

Unequivocal action of a button: a button identified by a certain number or letter had in the past only the function to place a call to the floor corresponding to said number. With a 10 digits-keypad solution this is no longer possible, since the button identified by the number 1, for example, is used in combination with other buttons to place elevator calls to the floors "1x" and "x1".

Multi-button input: the user interface of the elevator was a one-action machine-man interface. With a 10 digits-keypad solution the user interface of the elevator becomes a two-action machine-man interface, since, for example, to place a call to the floors 10 and above, the user must push two buttons sequentially.

Optical acknowledgment: Because one button serves for different inputs, the optical acknowledgment of a pressed button and of a registered call would be equivocal.

Limits of the shaft: these are with a 10 digits-keypad solution no longer recognizable. The user cannot recognize if the uppermost floor of a building is the floor 6, 7, 10 or 12 for example.

Nonexistent floors: the indication of all the 10 digits (0 to 9) on the car operating panel disturbs the customers possessing elevators in buildings with only few floors, since they get confused by the presence of the highest digits (9, 8 . . . ), which do not correspond to any floor in the building.

It is necessary therefore to develop a standard car operating panel, which can be fully customized at the elevator installation itself and does not need special customizing operations in the factory. Said car operating panel can preferably be used without adding special components and exhibits also preferably a maintenance interface to change the elevator parameters.

An attempt to attain these goals is for example shown in German patent document DE 19539288 C2, in which a freely configurable and customizable car operating panel for an elevator is disclosed, which exhibits freely programmable touch sensitive buttons and a maintenance mode for elevator service.

Such a car operating panel exhibits, however, the disadvantages to be expensive, not user-friendly, complex to be configured, and not esthetically attractive. Furthermore, this apparatus exhibits a difficult fabrication and assembly and cannot be produced using well-established components. The advantages for logistic are therefore lost. This apparatus, furthermore, does not conform to the norms concerning handicapped people, since blind people cannot recognize by tact the floor numbers on the keyboard. According to the standards EN 81-70, these requirements must be fulfilled for elevator push buttons: an operating force between 2.5 and 5 N, an operating and registration feedback and floor numbers in relief with a minimal height of 0.8 mm.

Accordingly, it is an object of the present invention to provide a car operating panel for an elevator installation which is freely configurable, inexpensive, user-friendly, conform to the norms concerning handicapped people, assembled using well-established standard components and esthetically attractive for the users.

SUMMARY OF THE INVENTION

A car operating panel, which solves this problem according to the present invention, concerns an elevator with a car operating panel, comprising push buttons corresponding to floors of a building, wherein said push buttons act on switch contacts registering elevator calls and wherein said push buttons are reversibly mountable on the switch contacts by position lock or frictional contact or glued joint.

Said push buttons are parts of the car operating panels, which can place an elevator call, when pushed for example by the human finger of an elevator user.

They place a call by acting on a switch contact or sensor, which generates and transmits the call signal to the elevator control.

These switch contacts are meant freely configurable, when the floor to which they correspond and to which they place a call, can be freely changed and programmed.

The set of combinations switch contact-floor constitutes a specified configuration, which can be set up for example by a service man at the moment of the installation of the elevator in a building, on the ground of the number of floors exhibited by said building.

If the switch contacts correspond to real and physical floor in a building, they are configured as active or activated.

If the switch contacts do not correspond to any real and physical floor in the building, they are configured as inactive or deactivated.

A blank element is a part of the car operating panel, which is not marked by any indication of a floor number or concerning another elevator function.

It is preferably not movable and does not allow then the activation of the switch contact underlying it.

Push buttons can be lighted, when a light source generates light making them distinguishable from the other push buttons. This does not make sense with a conventional 10 digits-keypad solution.

The present invention exhibits the advantages that car operating panel can be freely configured according to the building in which is mounted in a very user-friendly way, without the need of expensive components or complex operations. Since the configuration is carried out only by mounting by position lock or frictional contact or glued joint determined push buttons of the car operating panel, corresponding to the active switch contacts, said configuration can be carried out in a very fast, elegant and time non-consuming way. Additional mechanical components are not required. The configuration can always be carried out on the same type of car operating panel, maintaining in such a way all logistic advantages offered by a unique factory produced car operating panel. An additional advantage is that in case of failure of a push button said defective push button can be easily replaced, with no need to demount the entire car operating panel or replace it entirely.

Alternately said push buttons are mountable on the switch contacts by snap action or by screws.

These two mounting methods seem to offer the most practical, fast and cheap way of mounting and demounting the push buttons.

The switch contacts are freely configurable to correspond to floors of a building according to a specified configuration. This preferred embodiment exhibits the advantage, that each combination and order of push buttons placing calls to a determined floor can be achieved, with no restriction of any type.

The push buttons marked with a floor number are mounted on the switch contacts activated to place elevator calls to said floor and inactive switch contacts are covered by a blank element. This preferred embodiment exhibits the advantage that inactive switch contacts not only are disabled to place calls to the elevator control, but are also not perceived at all by the elevator users, not generating thereby any type of confusion or annoyance.

The push buttons comprise a frame, which is mountable by snap action. This preferred embodiment exhibits the advantage that while snapping the push buttons onto the switch contacts, no elevator call is mistakenly placed by exerting pressure onto the switch contacts.

The car operating panel exhibits a 10 digits-keypad consisting in a symmetric matrix of 12 configurable touch sensitive buttons arranged in 3 columns and 4 lines. This embodiment exhibits the advantage to use standard components already present nowadays in the market.

A button arrangement is provided comprised in a floor range from −3 to 8 and blank elements cover the inactive switch contacts. This embodiment exhibits the advantage to be suited to the most spread buildings and to the most common floor configurations, which occur in the market.

The push buttons, when actuated to register an elevator call, are configured to be lighted on, in a manner that the acknowledgement of the elevator call is visible. In the case of a conventional 10 digits-keypad, the registration and acknowledgement of button is visible in a destination indicator above the button part unit or in a separate display. This embodiment exhibits the advantage that the intuitive perception of the call acknowledgment is very fast and clear in the human brain of the elevator user.

The buttons are lighted on by a backlight generated by LED's. This embodiment exhibits the advantage that the light generating devices are very small and inexpensive.

The light acknowledging a registered elevator call blinks with a predetermined intermittency. This embodiment exhibits the advantage that the intuitive perception of the call placement is increased.

The switch contacts are configurable to correspond to elevator operations and/or functions to be carried out and/or activated during maintenance or service. This embodiment exhibits the advantage that an additional maintenance man-elevator interface is not required and place and costs can be saved.

The push buttons are provided with Braille signs in relief indicating the floors assigned to the buttons, in such a way that they are recognizable by a blind person. This embodiment exhibits the advantage that the elevator installation is made compatible with the norms relating to handicapped people.

The push buttons for an elevator car operating panel are provided, said push buttons being mountable on the switch contacts of the elevator car operating panel by snap action or by screws. This embodiment exhibits the advantage that different types of push buttons can be provided by different suppliers and sold for example in the form of elevator button kits, which can be easily produced and bought in the market and which can be easily mounted during an elevator installation or supplied to the customers and elevator users themselves in view of an elevator upgrade or modernization.

DESCRIPTION OF THE DRAWINGS

The above, as well as other advantages of the present invention will become readily apparent to those skilled in the art from the following detailed description of a preferred embodiment when considered in the light of the accompanying drawings in which:

FIG. 1 is a schematic front elevation view of a conventional prior art car operating panel with a 10 digits-keypad;

FIG. 1A is a side elevation view and FIG. 1B is a top plan view of the panel shown in FIG. 1;

DESCRIPTION OF THE PREFERRED EMBODIMENT

Figure 2:
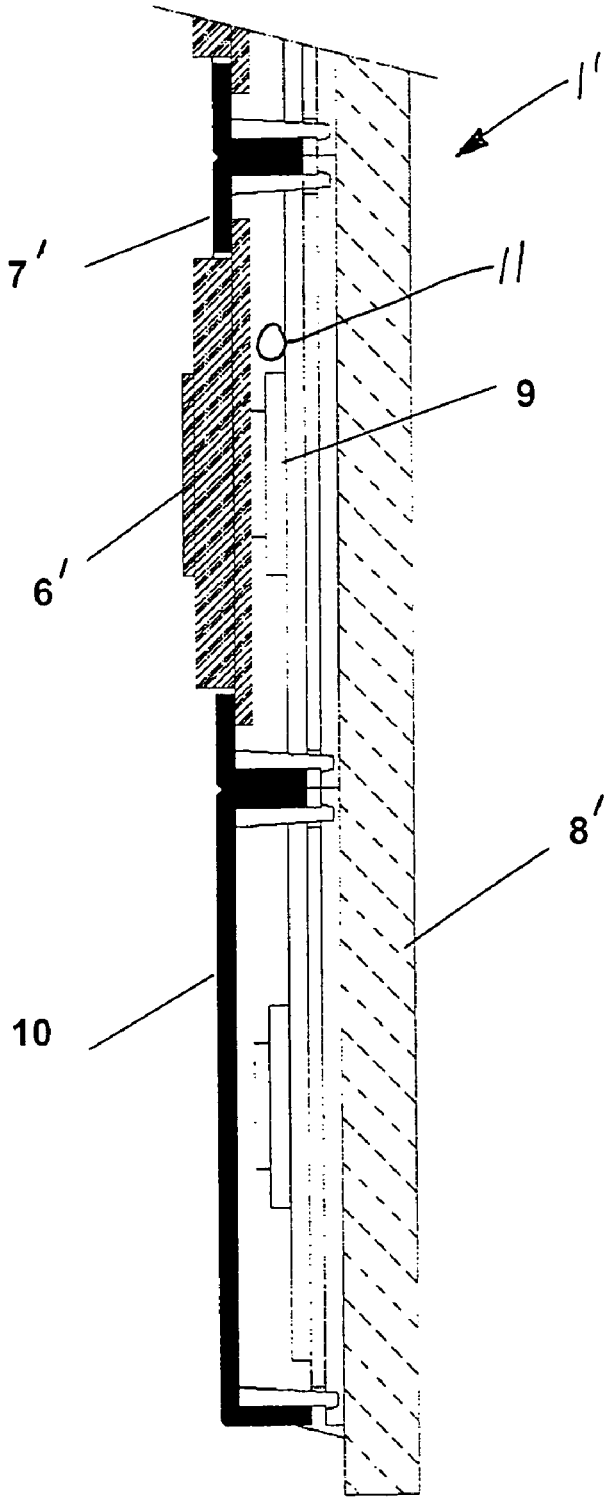
FIG. 2 is a schematic fragmentary side elevation view in cross section of the push buttons and blank elements mounted on the switch contacts, according to a preferred embodiment of the present invention.

FIG. 1 shows a car operating panel 1 known in the state of the art. The car operating panel 1 exhibits a keypad 2, which, in this example, is characterized by 10 digits arranged in a predefined spatial order (10 digits-keypad). The keypad 2 exhibits push buttons 6, which are used to place elevator calls to the building floors. The push buttons are movable in the horizontal direction in order to place the calls and are firmly and undetachably mounted onto switch contacts, for example by means of gluing or welding. They act on the switch contacts in order to place the elevator calls. A frame 7 surrounds the push buttons. This frame 7 is firmly and undetachably fixed to a base 8 of the car operating panel 1, for example by means of gluing or welding. The floors corresponding to the push buttons 6 are indicated by black markings indelibly stamped or laser-printed on the push buttons. The switch contacts (not shown) are arranged behind the areas corresponding to the push buttons 6 to produce an electrical signal, which is then generated through the touching of a human finger. In this way, the car operating panel 1 can detect elevator calls placed by a user and transmit them to the elevator control. The operating panel 1 is also provided with a position indicator 3, which displays at which floor the elevator car is traveling at a specific instant. A destination indicator 4 is also usually provided, which shows all calls which have been placed and must be still served. No button acknowledgement is possible for the placed calls. Auxiliary signs 5 are preferably provided, which point out special conditions of the elevator equipment, such as alarm, emergency and similar auxiliary indications. The alarm and emergency symbols are not visible in the normal use. Therefore elevator users are not alarmed about this possibility.

This car operating panel 1 exhibits evident advantages from the point of view of the logistic, since a unique operating panel in this form can be produced industrially and introduced everywhere in different types of buildings, with dramatic cost advantages.

This car operating panel 1 exhibits, however, the disadvantage, that the 10 digits (0 to 9) are always displayed on the keypad 2, since they have been indelibly stamped or laser printed on the push button surface and the push buttons 6 cannot be easily replaced. The push buttons 6 are firmly and undetachably connected with the switch contacts, while the frame 7 is firmly and undetachably connected with the base. The 10 digits are, for example, also displayed, when the car operating panel 1 is mounted in a building with only two floors, in which the digits ranging from three to nine would be unnecessary, which brings confusion and complaints from the concerned customers and users.

Furthermore, if one push button 6 is defective, it is necessary to demount and replace the entire circuit board (PCB), in which the switch contacts are mounted.

Besides such a car operating panel 1 is not configurable and the floors which correspond to determined push buttons 6 cannot be changed, since the push buttons 6 and the keypad 2 cannot be adapted.

This prevents, for example, such an operating panel 1 to be adapted to buildings, where floors below the ground are present(−1, −2 . . . ) and to circumstances, where it would be desirable or compulsory to have the digit 0 in the lowest left area of the keypad 2.

FIG. 2 shows a car operating panel 1' according to preferred embodiment of the present invention, which solves all cited problems.

Figures 3, 3A, 3B:
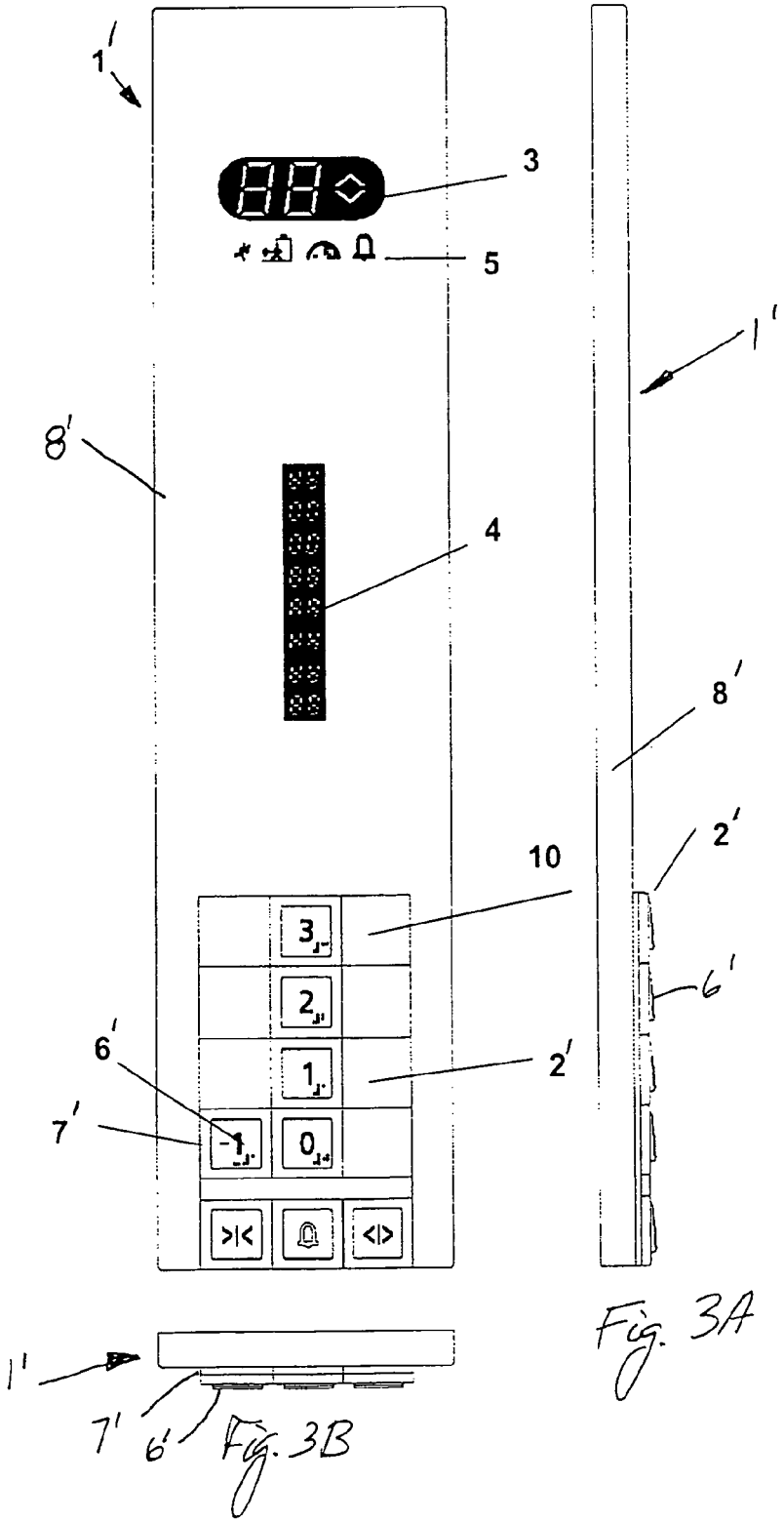
FIG. 3 is a schematic front elevation view of a car operating panel according to the present invention.
FIG. 3A is a side elevation view and FIG. 3B is a top plan view of the panel shown in FIG. 3.

In this embodiment, push buttons 6' of a keypad 2', which correspond to floors which are effectively present in the building and which are therefore active, are snapped onto switch contacts 9 by means of a snap-in push button frame 7'. The push button 6' comprises then a movable central part, which is used to place elevator calls, and an external frame part 7', which is fixed and is used to snap the push buttons 6' on the switch contacts 9. The active push buttons 6' are therefore easily installable and replaceable. When a switch contact 9 on the keypad 2' does not correspond to a floor which is effectively present in the building and is therefore inactive, this switch contact is made invisible by coveting it with a blank element 10 (FIGS. 2 and 3). The inactive switch contact 9 is therefore totally invisible for the user and cannot be activated. At the same time the elevator control stops these switch contacts from being enabled to place elevator calls.

The snap action fastening means of this preferred embodiment control panel can be replaced by any other suitable reversible positive lock mounting system of the push buttons 6'.

Alternatively, the push buttons 6' and the blank elements 10 can be mounted with screws or by any other suitable frictional connection system.

A glued joint can be also provided between the push buttons and the switch contacts, whereby the push buttons can be easily and rapidly demounted by an increase of the temperature or by the action of ultrasounds, which make the glued joint weaker.

The car operating panel 1' is therefore freely configurable through the releasable fastening means and can be customized to the building configuration in a very user-friendly and inexpensive way.

In the example of FIG. 3, by snapping new push buttons 6' onto the switch contacts 9 in a keypad similar to that represented in FIG. 1, it was possible to achieve a different succession of digits, which was required by the floor configuration of the building in which the car operating panel had to be installed. This building exhibited the floors −1 to 3.

The push buttons 6' corresponding to the active floors must be so positioned on the switch contacts 9, that the digit marked on them corresponds to the floor, for which the switch contact has been enabled by the elevator control to place a call.

In FIG. 3 the switch contacts 9 corresponding to floors higher than 3 and lower than −1 are not visible, since they are covered by the blank elements 10. These switch contacts 9 correspond to inexistent floors, are made invisible and are not allowed by the elevator control to place calls.

By positioning the push buttons 6' onto the switch contacts 9, all possible successions of digits can be obtained. The car operating panel 1' is therefore totally configurable and can be customized to each building and required floor configuration.

Note that the components of the car operating panel 1' are always the same. The same car operating panels, push buttons, keypads, bases and switch contacts arrangements must be produced by the elevator factory. From the point of view of the logistic and industrial production, no disadvantage occurs because of the introduction of the inventive car operating panel 1'.

Note also that the configuration operations are very simple and do not require any special electronic hardware or software programs to be executed. The configuration can be carried out manually by any person in a very fast, user-friendly and inexpensive way by using well-established factory produced components.

With this concept, once defined the button symbols and the maximal number of call buttons, the car panel can be customized directly in the field without the need of a factory customization. The service man can define which switch contacts have to be activated by entering the lowest floor offset of the building. The elevator control knows how many floors are in the building and can activate automatically the necessary switch contacts.

Thanks to the present invention, kits of the elevator push buttons 6' can be produced and sold independently from the fabrication and installation of an elevator. These kits can be provided to maintenance personal, customers and even elevator users, so that they can personalize, upgrade or modernize their elevator installations corresponding to their wishes with no need of complex and expensive technical operations.

In the preferred embodiment of FIGS. 3, 3A and 3B the push buttons 6' actuated to register an elevator call, are configured to be lighted on with blue light generated by LEDs 11 (FIG. 2) placed behind the buttons, in a manner that the acknowledgement of the elevator call is visible.

In addition to the backlight, the elevator call is also acknowledged by a blinking with a pre-determined intermittency of the light. An audible signal could be provided as well.

FIG. 3 shows the car operating panel 1' according to the present invention as installed in a building with floors ranging from −1 to 3. With this car operating panel 1' different button arrangements are possible inside a floor range from −3 to 8. A maximum of 12 stops can be achieved. This car operating panel is, however, especially suited for the following floor ranges, which are the most common in our cities:

−1 to 2, −1 to 3, −1 to 4, 0 to 2, 0 to 3, 0 to 4, −2 to 2, −2 to 3, −2 to 4, −3 to 8.

In case of public buildings, in which elevator installations must meet norms relating to handicapped people, the push buttons must exhibit Braille signs in relief indicating the floors assigned to the buttons, in such a way that they are recognizable also by a blind person. An operating force between 2.5 and 5 N, an operating and registration feedback and floor numbers in relief with a minimal height of 0.8 mm are also compulsory requirements.

The switch buttons 6' of the car operating panel 1' shown in FIG. 3 are configurable to correspond to elevator operations and functions to be carried out and activated during maintenance or service.

The maintenance interface is a classical 10 digits-keypad and is used as input for the maintenance and configuration functions of the elevator.

A 10 digits-keypad kit of push buttons, similar to that one displayed in FIG. 1 must be preferably provided to the maintenance personal, so that these supplied buttons can be snapped in and the configuration mode functions are then clearly evident to the service personal on the elevator-man interface of the keypad. In another preferred solution, the 10 digits-keypad buttons are dismantled and then the switches are directly free for the programming/configuration mode. After configuration, the buttons are fixed again and the car operating panel is ready to use. Switches on PCB are marked with the 10 digits-keypad numbers, and no additional key pad unit tool for programming is needed.

Covered switch elements 9, which are not used in the normal mode, are available in the configuration mode.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car operating panel having a plurality of push buttons corresponding to floors of a building, wherein the push buttons act on switch contacts to register elevator calls, comprising:

a base;

a plurality of switch contacts mounted on said base in a keypad array and freely being configurable for entering elevator calls to the floors of the building;

a plurality of push buttons each corresponding to a floor of the building; and a plurality of frames, each said frame being releasably attached to said base and retaining an associated one of said push buttons on one of said switch contacts whereby after said switch contacts have been configured to place elevator calls for the floors, each said frame and said associated push button are attached to said base on a one of said switch contacts configured to enter the elevator call for the floor corresponding to said associated push button.

2. The panel according to claim 1 wherein each said push button and associated frame is mounted on said base by a releasable fastening means.

3. The panel according to claim 2 wherein said releasable fastening means is a snap action cooperation between said frame and said base.

4. The panel according to claim 1 wherein said switch contacts are freely configurable to correspond to the floors of the building according to a specified configuration.

5. The panel according to claim 1 wherein said push buttons on activated ones of said switch contacts are each marked with a floor number associated with the corresponding floor and inactive ones of said switch contacts are each covered by a blank element.

6. The panel according to claim 1 wherein said push buttons are positioned in a symmetric matrix of twelve push buttons arranged in three columns and four lines.

7. The panel according to claim 1 wherein said push buttons are positioned in an arrangement for a floor range comprised between −3 and 8 and wherein blank elements cover inactive ones of said switch contacts.

8. The panel according to claim 1 wherein said push buttons permit light to be visible when actuated to register an elevator call to indicate acknowledgement of the elevator call.

9. The panel according to claim 8 wherein said push buttons are lighted by a backlight generated by at least one LED.

10. The panel according to claim 8 wherein the light acknowledging a registered elevator call blinks with a predetermined intermittency.

11. The panel according to claim 1 wherein said switch contacts are configurable to correspond to at least one of elevator operations and functions to be at least one of carried out and activated during at least one of maintenance and service.

12. The panel according to claim 11 wherein each of said switch contacts is made available for configuration by removing said frame and said associated push button from said base.

13. The panel according to claim 1 wherein said push buttons are provided with Braille signs in relief indicating the floors assigned to said push buttons to a blind person.

14. The panel according to claim 1 wherein said push buttons are removably attached to said switch contacts.

* * * * *